US005556035A

United States Patent [19]

Daub

[11] Patent Number: 5,556,035

[45] Date of Patent: Sep. 17, 1996

[54] ARRANGEMENT FOR COOLING ROLLED STRIPS

[75] Inventor: Dieter Daub, Hilchenbach, Germany

[73] Assignee: SMS Schloemann-Siemag Aktiengesellschaft, Dusseldorf, Germany

[21] Appl. No.: 332,998

[22] Filed: Nov. 1, 1994

[30] Foreign Application Priority Data

Nov. 2, 1993 [DE] Germany ..... 43 37 342.9

[51] Int. Cl.[6] ..... B05B 1/00

[52] U.S. Cl. ..... 239/455; 239/590; 239/597

[58] Field of Search ..... 239/597, 455, 239/568, 590, 553.5

[56] References Cited

U.S. PATENT DOCUMENTS 2,949,239 8/1960 Goyette ..... 239/568 X
3,040,523 6/1962 Price ..... 239/455 X
3,662,954 5/1972 Pepmeier ..... 239/568 X
4,515,313 5/1985 Cavanagh ..... 239/455

FOREIGN PATENT DOCUMENTS 493734 10/1952 Italy ..... 239/455

*Primary Examiner*—Kevin P. Weldon
*Attorney, Agent, or Firm*—Friedrich Kueffner

[57] ABSTRACT

An arrangement for cooling rolled strips, particularly for laminar cooling when rolling aluminum strips, includes cooling segments whose outer sides are closed with a cover, wherein each cooling segment has a media gap extending over the entire length of the cooling segment, and wherein several cooling segments can be arranged next to each other in such a way that a media gap is obtained which extends without interruption from cooling segment to cooling segment.

5 Claims, 3 Drawing Sheets

ARRANGEMENT FOR COOLING ROLLED STRIPS

BACKGROUND OF THE INVENTION

1. Field of the Invention

The present invention relates to an arrangement for cooling rolled strips, particularly for laminar cooling when rolling aluminum strips.

2. Description of the Related Art

It is known in the art to provide a strip cooling unit between the individual stands of a rolling train. The strip cooling unit has the purpose of adjusting the temperature or cooling the rolled strip during rolling to a range which is uncritical for the rolling emulsion used, for example, petroleum. For this purpose, spray beams are used which are provided with a long slot whose length corresponds to the width of the strip and which are screwed onto a substructure. In order to increase the cooling intensity, several of these spray beams can be arranged one behind the other. Specific areas of this known cooling unit can only be switched off by using covers which are moved from both sides of the spray beam over the slot.

SUMMARY OF THE INVENTION

Therefore, it is the primary object of the present invention to provide an arrangement for cooling rolled strips of the above-described type which is easier to maintain and operate and whose possibilities of use are more variable.

In accordance with the present invention, the arrangement for cooling rolled strips includes cooling segments whose outer sides are closed with a cover, wherein each cooling segment has a media gap extending over the entire length of the cooling segment, and wherein several cooling segments can be arranged next to each other in such a way that a media gap is obtained which extends without interruption from cooling segment to cooling segment.

In this connection, a media gap is understood to be the discharge or outlet gap for the liquid cooling medium, for example, rolling oil, water, etc.

The covers can be placed in a base member in such a way that they are flush relative to each other but do not interrupt the media gap. The base member is provided with a continuous distribution bore which has at least one supply connection and is in communication with the media gap. Since the covers close off the ends of the cooling segment or the base member, the operability of the cooling segment can be pretested in a simple manner before its assembly.

The covers which close off the sides of the cooling segments in a flush manner and do not interrupt the media gap, make it possible to arrange several cooling segments next to each other, wherein an essentially transition-free laminar flow exists at the joints between the cooling segments. In other words, there is no difference between the gaps of the individual cooling segments and, when the cooling segments are arranged next to each other, they form a continuous and common media gap.

The construction of the cooling arrangement with cooling segments makes it possible to adapt the strip cooling to the width of the strips being rolled at a given time. This is because one or more cooling segments can be arranged next to each other depending on the width of the strips. Simultaneously, since each cooling segment has at least one supply connection for the cooling medium to be supplied to the media gap, it is easily possible to switch off the cooling arrangement in certain areas by switching off the media supply to the respective cooling segments. In view of the fact that the cooling segments are operated with low pressures of the cooling medium (starting at 0.01 bar), sealing members are unnecessary because the mechanical surface quality is sufficient for sealing.

Finally, because of the laminar flow which is essentially without transition at the joints between cooling segments, the cooling segments are simple to manufacture. This is because the cooling segments can be dimensioned in such a way that the distribution bore extending over the entire length of the base member can be manufactured by using conventional drilling techniques. Furthermore, maintenance and service are simplified because the cooling segments can be exchanged.

In accordance with an advantageous further development of the invention, the base member has an opening which axially exposes the distribution bore. Together with a sliding wedge arranged in the opening and provided with a corresponding guide surface, the opening of the base member forms the media gap. Because of the presence of the guide surfaces, a jet of the discharge cooling medium can be achieved which is guided over a long distance. This is advantageous for a laminar flow of the medium, as are smooth surfaces of the media gap. The cooling segments can be arranged directed toward the rolled strip from above and/or from below. For physical reasons, it is advantageous to direct the cooling segments against the rolled strip from below. The distance from the rolled strip may be approximately 50 to 100 mm.

In accordance with a recommended feature, the sliding wedge is provided with a nose which projects into the distribution bore in order to obtain a uniform pressure distribution of the cooling medium in the distribution bore.

In accordance with another recommended feature, the width of the media gap is individually adjustable in each cooling segment. The width of the media gap may be adjustable between 0 and 3 mm. The gap width and the shape of the media gap resulting from the inclined guide surfaces result in an optimum geometry of the gap and, thus, in a quiet operation of the cooling segments.

In accordance with an advantageous feature of the invention, blocks which are fixedly mounted in the base member engage in grooves provided in the sliding wedge. Each block is provided in the area of the grooves with an adjustment screw which is accessible from the outside. As a result, by screwing in the adjustment screw to a certain extent, it is possible from the ends of the cooling segment to displace the sliding wedge and, thus, to adjust the gap. The adjustment screw may be a headless screw. For controlling the width of the gap, measuring gauges or feeler gauges may be placed between the guide surfaces.

In accordance with another recommended feature, the cooling segments are screwed to a steel structure which receives the cooling segments in a box-like manner. As a result, the cooling segments which cannot only be arranged next to each other but also one behind the other in any chosen quantity, are mounted on a support frame. If a liquid is used as cooling medium, the support frame simultaneously serves to collect and return the cooling medium which is being circulated.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
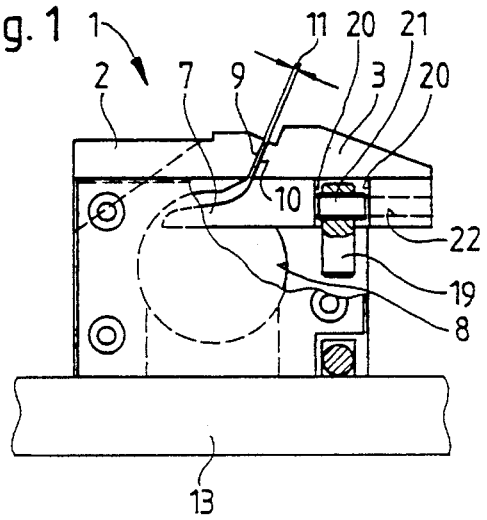
FIG. 1 is a schematic side view, partially in section, of a cooling segment of the cooling arrangement according to the present invention.
Figure 4:
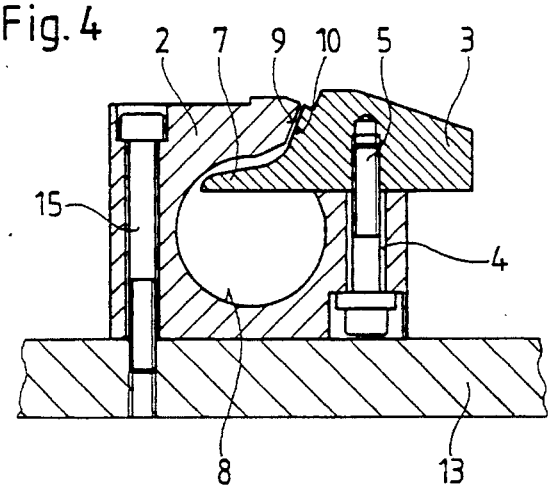
FIG. 4 is a sectional view of the cooling segment taken along sectional line IV—IV of FIG. 2.
Figure 5:
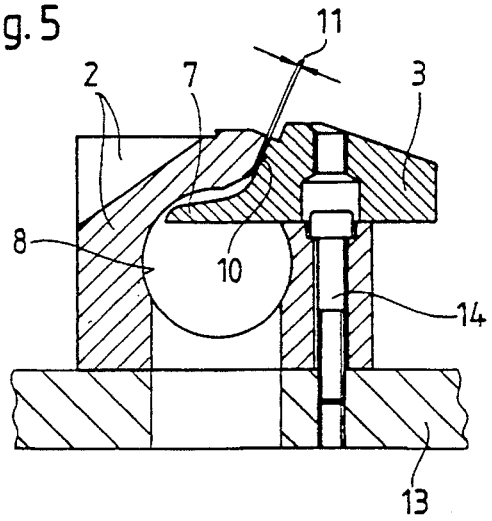
FIG. 5 is a sectional view of the cooling segment taken along sectional line V—V of FIG. 2.

FIG. 1 of the drawing shows the narrow side or front side of a cooling segment 1. The cooling segment 1 is composed of a base member 2 whose cross section is essentially rectangular, as seen in FIGS. 4 and 5 in connection with FIG. 7. The cooling segment 1 further includes a sliding wedge 3 which is adjustably mounted on the base member 2. The sliding wedge 3 is secured by means of screws 5, as shown in FIG. 4, which are placed from below in through-bores 4 of the base member 2. The bores 4 are provided with a sufficient radial free space for carrying out adjustment movements. The sliding wedge 3 is placed in an opening 6, best seen in FIG. 7, which extends over the entire length of the base member 2 of the cooling segment 1. The sliding wedge 3 projects with a nose 7 into a distribution bore 8 which extends through the base member 2 in longitudinal direction, as can be seen in FIGS. 4 and 5.

Figure 7:
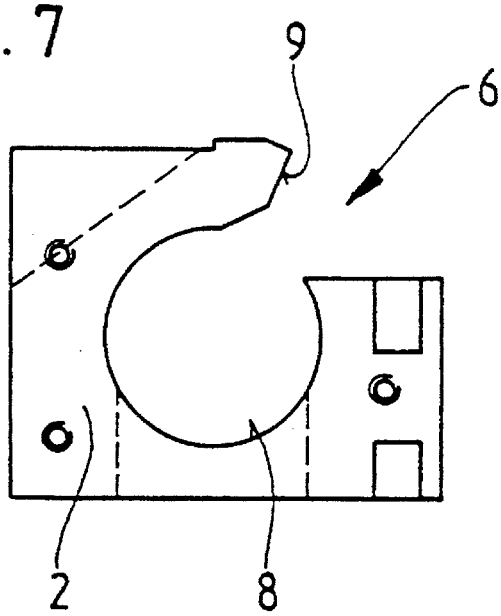
FIG. 7 is a side view of a base member of the cooling segment of FIGS. 2 and 6.

As shown in FIG. 7, the opening 6 of the base member 2 which extends into and axially exposes the distribution bore 8 has an inclined guide surface 9. Together with a corresponding guide surface 10 of the sliding wedge 3, the guide surface 9 forms a media gap 11 through which the cooling medium is discharged and sprayed against a rolled strip, not shown. In FIGS. 4 and 5, the media gap 11 is shown in its basic position. The size of the of the media gap 11 can be adjusted by adjusting the sliding wedge 3.

The cooling medium, for example, water, is supplied to the distribution bore 8 through supply connections 12 which are arranged distributed over the length of the cooling segment 1. In the embodiment illustrated in FIGS. 2 and 3, three supply connections 12 are provided. The connections 12 extend into a box-like steel structure 13 which is only schematically illustrated in the drawing and supports the cooling segments 1. The connections 12 are connected to a cooling medium supply unit, not shown. The cooling segments 1 are screwed to the steel structure 13 by means of fastening screws 14 which, as shown in FIG. 5, are inserted from above through the sliding wedge 3 and the base member 2 and by means of fastening screws 15, shown in FIG. 4, which are inserted through the base member 2 on the side facing away from the sliding wedge 3.

Figure 2:
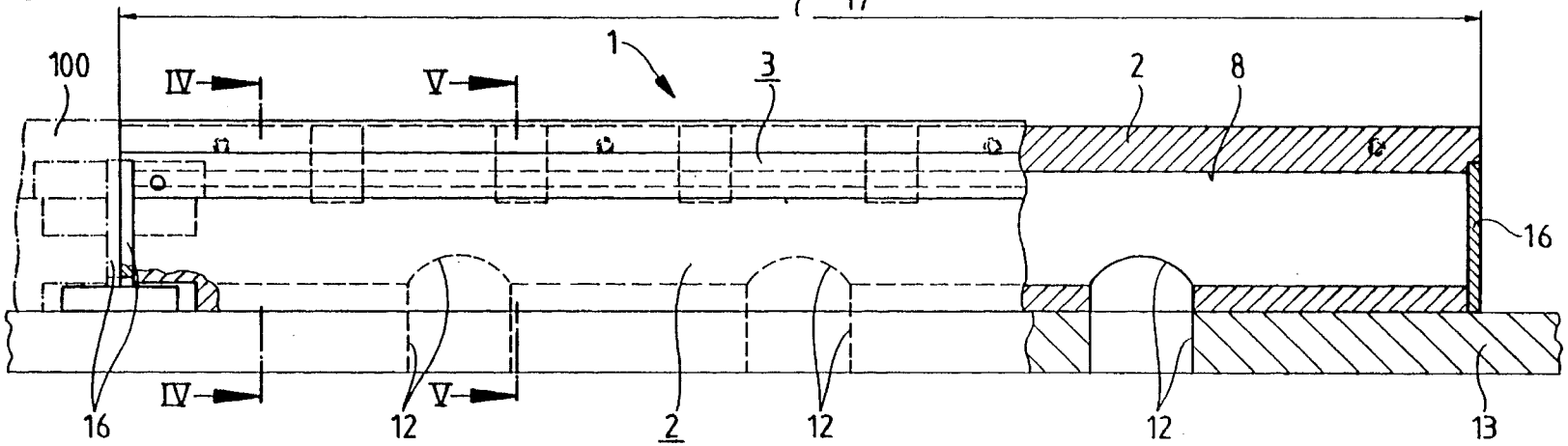
FIG. 2 is a side view, partially in section, of the cooling segment of FIG. 1, seen from the right as shown in FIG. 1.
Figure 3:
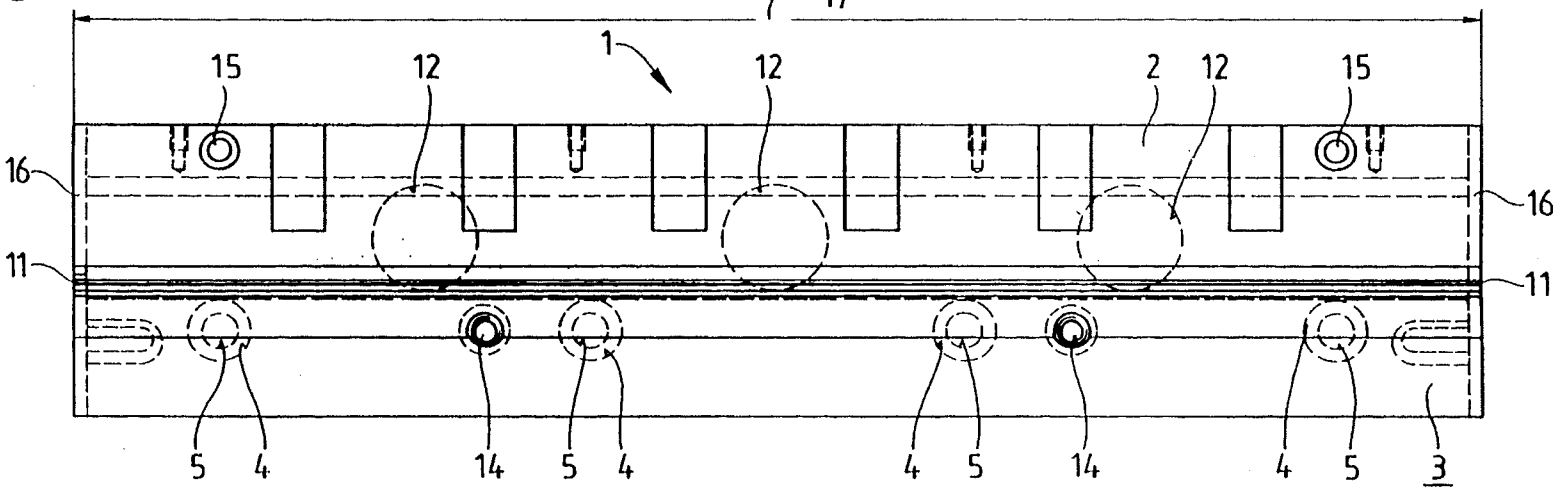
FIG. 3 is a top view of the cooling segment of FIG. 2.
Figure 6:
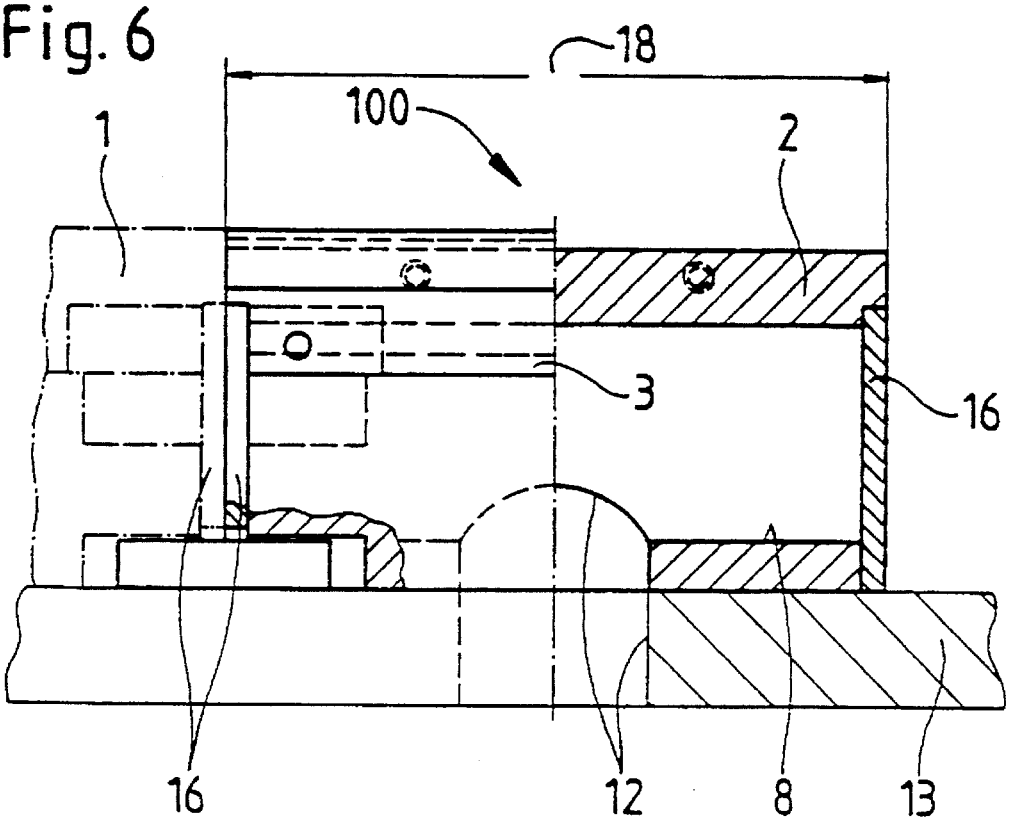
FIG. 6 is a side view, partially in section, of another cooling segment which is significantly narrower than the cooling segment shown in FIGS. 2 and 3.

The narrow sides of the cooling segment 1 are provided with covers 16 which are placed in the base member 2 so as to extend flush with the outer end faces of the base member 2. The covers 16 close off to the outside the distribution bore 8 which extends over the entire length 17 of the cooling segment 1, as shown in FIG. 6 and the length 18 of the cooling segment 100, as shown in FIG. 6. The covers 16 are constructed in such a way that they end below the media gap 11 defined by the guide surfaces 9 and 10, i.e., the covers 16 do not cover the media gap 11, as seen in FIG. 1. Accordingly, if a cooling segment 1 having a great length 17 is equipped for cooling a rolled strip which has a greater width by placing a cooling segment 100 having a smaller length 18 against the cooling segment 1, the media gaps 11 are in communication without interruption at the joints between one cooling segment 1 and the other cooling segment 100, as can be seen in FIGS. 2 and 6, so that a transition-free laminar flow can be maintained in this manner.

Apart from having different lengths, there is no difference between the cooling segment 1 and the cooling segment 100 shown in FIG. 6. However, the shorter length 18 of the cooling segment 100 only requires one supply connection 12 for supplying the cooling medium into the distribution bore 8. Since the cooling segments 1, 100 can be placed next to each other with the media gaps 11 extending essentially without transition, it is possible in a simple manner to adapt the segment width of the strip cooling unit to the actual requirements, particularly to the width of the rolled strip.

In order to be able to adjust the width of the media gap 11, the sliding wedge 3 is adjustably arranged in the base member 2. For this purpose, blocks 19 are fastened at the front and rear ends of the base member 2. As shown in FIG. 1, the blocks 19 extend with projecting ends into corresponding grooves 20 in the sliding wedge 3. An adjustment screw 21 screwed into the projecting end of the block is accessible from the outside for an operator through a bore 22. Depending on the play or free space in the groove 20, the sliding wedge 3 with its guide surface 10 can be moved toward or away from the corresponding guide surface 9 of the base member 2 by turning the screws 21, which means that the width of the media gap is variably adjustable.

The invention is not limited by the embodiments described above which are presented as examples only but can be modified in various ways within the scope of protection defined by the appended patent claims.

I claim:

1. An arrangement for cooling rolled strips, particularly for laminar strip cooling during rolling of aluminum strips, the arrangement comprising at least one cooling segment having end faces, the cooling segment having a length, a cover mounted on each of the end faces for closing the cooling segment, the cooling segment defining a media gap for discharging cooling medium with low pressure, the media gap extending over the entire length of the cooling segment, the media gap being configured such that when two or more cooling segments are placed against each other at the end faces thereof, a continuous transition-free media gap extends along the cooling segments, wherein the at least one cooling segment comprises a base member, the covers being mounted flush in the base member without covering the media gap, the base member having a distribution bore extending along the length of the cooling segment and being in communication with the media gap, the at least one cooling segment further comprising at least one supply connection for supplying cooling medium to the distribution bore, wherein the base member has an opening defining an inclined guide surface, the opening being in communication with the distribution bore, further comprising a sliding wedge mounted on the base member and extending into the opening, the sliding wedge having a guide surface, the guide surface of the opening and the guide surface of the sliding wedge forming the media gap, and wherein the sliding wedge has a nose, the nose extending into the distribution bore.

2. The arrangement according to claim 1, wherein the media gap has a width, the sliding wedge being adjustable for adjusting the width of the media gap.

3. The arrangement according to claim 2, comprising blocks fixedly attached to the base member, the sliding wedge having grooves, the blocks engaging in the grooves, an adjustment screw accessible from outside being mounted in each block at each groove for adjusting the width of the media gap.

4. The arrangement according to claim 1, wherein each cooling segment has at least one supply connection.

5. The arrangement according to claim 1, comprising a steel structure for receiving the at least one cooling segment, the at least one cooling segment being screwed to the steel structure.

* * * * *